US005098521A

United States Patent [19]

Freudenberg et al.

[11] Patent Number: 5,098,521

[45] Date of Patent: Mar. 24, 1992

[54] PRODUCTION OF PAPER, BOARD AND CARDBOARD FROM PAPER STOCKS CONTAINING FOREIGN MATERIALS

[75] Inventors: Enrique Freudenberg, Schifferstadt; Friedrich Linhart, Heidelberg; Rainer Tresch, Maxdorf; Heinrich Hartmann, Limburgerhof; Walter Denzinger, Speyer; Michael Kroener, Mannheim; Norbert Sendhoff, Gruenstadt, all of Fed. Rep. of Germany

[73] Assignee: BASF Aktiengesellschaft, Ludwigshafen, Fed. Rep. of Germany

[21] Appl. No.: 639,097

[22] Filed: Jan. 9, 1991

[30] Foreign Application Priority Data

Jan. 25, 1990 [DE] Fed. Rep. of Germany ..... 4002065

[51] Int. Cl.[5] ..... D21H 17/45

[52] U.S. Cl. ..... 162/168.2; 162/164.6

[58] Field of Search ..... 162/168.2, 164.6; 210/735

[56] References Cited

U.S. PATENT DOCUMENTS 4,421,602 12/1983 Brunnmueller et al. ..... 162/168.2

4,772,359 9/1988 Linhart et al. ..... 162/168.2

*Primary Examiner*—Peter Chin

*Attorney, Agent, or Firm*—Oblon, Spivak, McClelland, Maier & Neustadt

[57] ABSTRACT

Paper, board and cardboard are produced from paper stocks containing foreign substances by drainage in the presence of a polymer which contains, as typical polymerized constituents, units of the formulae

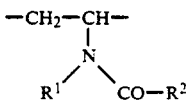

(I)

and

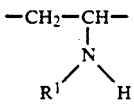

(II)

where $R^1$ and $R^2$ are each H, $C_1$-$C_3$-alkyl, and which have K values of not less than 130, the polymers containing less than 10 mol % of units of the formula II.

3 Claims, No Drawings

PRODUCTION OF PAPER, BOARD AND CARDBOARD FROM PAPER STOCKS CONTAINING FOREIGN MATERIALS

U.S. Pat. No. 4,421,602 discloses hydrolyzed homopolymers of N-vinylformamide which contain from 90 to 10 mol % of vinylamine units and from 10 to 90 mol % of N-vinylformamide units. The hydrolyzed polyvinylformamides are used as retention and drainage aids in papermaking. Owing to the vinylamine units, the polymers have a positive charge in aqueous solution. They are therefore adsorbed by the negatively charged surfaces of the solid particles in the paper stocks and thus facilitate binding of the originally negatively charged particles to one another. Consequently, a higher drainage rate and improved retention are observed. It is known that the efficiency of the cationic products is very adversely affected by the presence of foreign substances in the paper stocks. Foreign substances are oligomeric or polymeric substances which have an anionic charge character and adversely affect the drainage rate and the retention in papermaking. Such foreign substances accumulate in the water circulations of paper machines because the used water is increasingly recycled.

EP-A 0 249 891 discloses a process for the production of paper, board and cardboard, in which paper stocks containing foreign substances are drained in the presence of nonionic polymers, such as homopolymers of N-vinylformamide or of N-vinylpyrrolidone. The stated polymers act as retention aids and drainage aids. Their efficiency is considerably increased if nonionic condensates, for example condensates of phenol and formaldehyde of the resol and novolak type, are additionally present during drainage.

It is an object of the present invention to provide drainage and retention aids and flocculants for the papermaking process, which have greater efficiency than the polymers described above in paper stocks containing foreign substances.

We have found that this object is achieved, according to the invention, by a process for the production of paper, board and cardboard from paper stock containing foreign substances by drainage in the presence of a polymer which contains, as typical polymerized constituents, units of the formulae

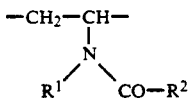

(I)

and

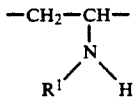

(II)

where $R^1$ and $R^2$ are each H and/or $C_1$–$C_3$-alkyl, and which has a K value of not less than 130 (determined according to H. Fikentscher in 5% strength by weight aqueous sodium chloride solution at 25° C. and at a polymer concentration of 0.1% by weight), if the polymer used is one in which the content of units of the formula II is less than 10 mol %

In the novel process, the paper stock which contains foreign substances and for whose preparation all fiber qualities either alone or as a mixture with one another are suitable is drained. Conventional amounts of inorganic fillers, for example clay, chalk, gypsum or titanium dioxide, and mixtures of these fillers may be added to the fibers. For the preparation of the paper stock, water is used in practice and some or all of this water is recycled from the paper machine. This is treated or untreated white water or a mixture of such water qualities. The recycled water contains larger or smaller amounts of foreign substances which, as stated above, have a very adverse effect on the efficiency of the conventional cationic retention and drainage aids. Such effects are described in, for example, the technical literature, cf. Tappi-Journal, Volume 70, Issue 10 (1987), 79. The content of such foreign substances in the paper stock can be characterized, for example, by means of the cumulative parameter chemical oxygen demand (COD). However, this cumulative parameter is also used as a measure of nonionic or low molecular weight substances which do not directly interfere with drainage or retention but are degradation products of wood ingredients and as such always occur together with foreign substances. The COD values of the paper stocks which contain foreign substances and are to be drained according to the invention are from 300 to 30,000, preferably from 1,000 to 20,000, mg of oxygen per kg of the aqueous phase of the paper stock containing foreign substances.

Fibers for the preparation of the pulps which contain foreign substances are, for example, mechanical pulps, unbleached chemical pulps, waste paper pulps and stocks obtained from all annual plants. Mechanical pulps include, for example, groundwood, thermomechanical pulp (TMP), chemothermomechanical pulp (CTMP), pressure-ground pulp, semichemical pulp, high yield pulp and refiner mechanical pulp (RMP). In the case of unbleached pulps, unbleached kraft pulp and unbleached sulfite pulp are particularly suitable. Regarding waste paper, all grades are suitable, both sorted and unsorted. Deinked waste paper pulps are particularly suitable. Annual plants which can be used for the production of stocks are, for example, rice, wheat, sugar cane and kenaf.

Examples of foreign substances which adversely affect the retention and drainage in papermaking are given in the technical literature, for example in the publications already cited above, Tappi-Journal, Volume 70, Issue 10 (1987), 79 and Wochenblatt für Papierfabrikation, 13 (1979), 493. According to these, the following compounds may be regarded as foreign substances: sodium silicate, which originates from the deinking process and from the peroxide bleaches of waste paper pulps, polyphosphates and polyacrylates from filler dispersions which are used in papermaking, humic acids from raw waters, carboxymethylcellulose from waste paper or coated waste, anionic starches from waste paper or coated waste, lignin derivatives from sulfate pulp, groundwood, TMP or CTMP, hemicelluloses and their degradation products from groundwood, TMP or CTMP and ligninsulfonates from unbleached sulfite pulps.

The production of paper, board and cardboard from the paper stocks containing foreign substances by drainage on a wire is carried out in the presence of a polymer which contains, as typical constituents, units of the formulae

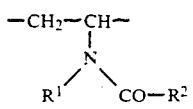

(I)

and

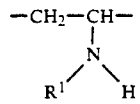

(II)

In formulae I and II, $R^1$ and $R^2$ may be identical or different and are each H and/or $C_1$–$C_3$-alkyl, preferably hydrogen.

The polymers which contain the units of the formulae I and II have K values of not less than 130 (determined according to H. Fikentscher in 5% strength by weight sodium chloride solution at 25° C and at a polymer concentration of 0.1% by weight). The polymers are obtainable by homopolymerization or copolymerization of N-vinylamide of the formula

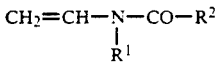

(III)

In formulae I and II, $R^1$ and $R^2$ have the stated meanings. Compounds of the formula III are, for example, N-vinylformamide, N-vinylacetamide, N-ethyl-N-vinylformamide, N-ethyl-N-vinylacetamide, N-methyl-N-vinylformamide, N-methyl-N-vinylacetamide and N-vinylpropionamide.

The homo- and copolymers of N-vinylamides of the formula III lead to homo- or copolymers which contain polymerized units of the formula I. To convert these into the polymers to be used according to the invention, which have units of the formulae I and II, the homo- and copolymers of the vinylamides of the formula III are hydrolyzed in the presence of an acid or base at not more than 170° C., for example from 20° to 170° C., preferably from 50° to 120° C. The degree of hydrolysis of the polymerized units of the formula I is essentially dependent on the concentration of the amounts of acid or base used and on the temperature. For the hydrolysis of the copolymers, mineral acids, such as hydrogen halides, sulfuric acid, nitric acid and phosphoric acid, and organic acids, e.g. acetic acid, propionic acid, benzeeesulfonic acid and alkylsulfonic acids, such as dodecylsulfonic acid, are suitable.

However, bases, for example hydroxides of metals of the 1st and 2nd main group of the Periodic Table of elements, eg. lithium hydroxide, sodium hydroxide, potasssium hydroxide, calcium hydroxide and magnesium hydroxide, can also be used for the hydrolysis. Other suitable bases are ammonia and derivatives of ammonia, for example triethylamine, monomethanolamine, diethanolamine, triethanolamine and morpholine. The hydrolysis of the homo- and copolymers of the N-vinylamides of the formula III is continued until less than 10, preferably from 1 to 9, mol % of the units of the formula I which are present in the polymers have been converted into units of the formula II. Poly-N-vinylformamide having a degree of hydrolysis of less than 10 mol % and a K value of from 160 to 250 is preferably used in the novel process. Copolymers which contain, as polymerized units, not more than 50, preferably not more than 30, % by weight of one or more other ethylenically- unsaturated monomers are also suitable. Examples of suitable comonomers for the N-vinylamides of the formula III are vinyl acetate, vinyl propionate, $C_1$–$C_4$-alkyl vinyl ethers, N-vinylpyrrolidone and esters, nitriles and amides of ethylenically unsaturated $C_3$–$C_8$-carboxylic acids, in particular esters, nitriles and amides of acrylic acid or methacrylic acid. Processes for the preparation of the hydrolyzed homo- and copolymers of compounds of the formula III are known. The hydrolyzed polymers may be present as an aqueous solution, a water-in-oil polymer emulsion, a powder or a bead polymer. Bead polymers are prepared, for example, by the known process of reverse suspension polymerization. The homo- and copolymers which are described above and contain less than 10 mol % of vinylamine units of the formula II are, according to the invention, added to a stock containing foreign substances, as drainage and retention aids and flocculants in amounts of from 0.002 to 0.1, preferably from 0.005 to 0.05, % by weight, based on dry paper stock. The polymers to be used according to the invention are added to the paper stock in very dilute aqueous solution, as is usual when other high molecular weight watersoluble polymers are used. The concentration in the aqueous solution is in general from 0.01 to 0.1% by weight. Compared with the known processes for the production of paper, board and cardboard from paper stocks containing foreign substances, the essential advantages of the novel process are the low sensitivity of the polymers containing less than 10 mol % of units of the formula II to the presence of foreign substances and the fact that there is no need to use any additional fixative for the high molecular weight polymer, as described in EP-A 0 249 891.

In the examples which follow, parts are by weight and percentages are based on the weight of the stocks. The K value of the polymers was determined according to H. Fikentscher, Cellulosechemie 13 (1932), 58-64 and 71-74; $K=k.10^3$. The K values of the polymers were determined at a polymer concentration of 0.1% by weight in 5% strength by weight aqueous sodium chloride solution at 25° C.

Methods of measurement

Determination of the drainage time 1 l of the paper stock suspension to be tested is drained in a Schopper-Riegler tester. The time determined for different outflow volumes is used as a criterion for the drainage rate of the particular stock suspension investigated. The drainage times are determined after a flow of 500 or 600 ml of water. Optical transmittance of the white water This is determined with the aid of a photometer and is a measure of the retention of fine particles and fillers. It is expressed as a percentage. The higher the value of the optical transmittance, the better the retention.

The charge density of the hydrolyzed polymers based on poly-N-vinylformamide is determined by an enzymatic formic acid determination method (company publication Methoden der enzymatischen Lebensmittelanalytik from Boehringer Mannheim GmbH, 1984).

The following polymers were tested as drainage and retention aids:

Polymer 1: Hydrolyzed poly-N-vinylformamide which contained 94.5 mol % of vinylformamide units (formula I where $R^1$ and $R^2$ are each H) and 5.5 mol % of 20 vinylamine units (cf. formula II where $R^1$ is H) and had a K value of 218.

Polymer 2: Partially hydrolyzed poly-N-vinyl-formamide which contained 96.5 mol % of N-vinylformamide units (cf. formula I where $R^1$ and $R^2$ are each H) and 3.5 mol % of vinylamine units (formula II where $R^1$ is H) and had a K value of 218.

Polymer 3: Partially hydrolyzed poly-N-vinyl-formamide which contained 93.3 mol % of N-vinylformamide units (formula I where $R^1$ and $R^2$ are each H) and 6.7 mol % of vinylamine units (cf. formula II where $R^1$ is H) and had a K value of 218.

The following polymers were tested for comparison:

Polymer 4: Homopolymer of N-vinylformamide having a K value of 218.

Polymer 5: Hydrolyzed poly-N-vinylformamide which contained 89.9 mol % of N-vinylformamide units and 10.1 mol % of vinylamine units and had a K value of 218.

EXAMPLE 1

A pulp having a consistency of 4 g/1 was prepared from 100% mixed waste paper. The pH of the stock suspension was 8.1. To simulate a deinked waste paper stock, 4%, based on dry paper stock, of waterglass were added to the paper stock. Samples of this paper stock were each drained in the presence of the polymers stated in Table 1. The polymers were each used in an amount of 0.04%, based on dry paper stock. The drainage times for 600 ml of filtrate in the Schopper-Riegler tester and the optical transmittance of the resulting filtrate are shown in Table 1. In Comparative Example 3, the paper stock described above was drained without any further addition.

TABLE 1

| | Addition to the paper stock | Drainage time [sec] | Optical transmittance [%] |
|---|---|---|---|
| Example 1 | Polymer 3 | 49.6 | 56 |
| Comp. Example 1 | Polymer 4 | 61.3 | 52 |
| Comp. Example 2 | Polymer 5 | 58.7 | 51 |
| Comp. Example 3 | — | 104 | 10 |

EXAMPLE 2

A pulp having a consistency of 4 g/1 was prepared from 80 parts of TMP stock, 20 parts of bleached sulfate pulp and 30 parts of kaolin as a filler. The pH was brought to 6.0 by adding allum. To simulate a paper stock containing foreign substances, 50 ml of an aqueous TMP extract from large-scale TMP production were added per liter. The polymers shown in Table 2 were added to this paper stock, in an amount of 0.02%, based on dry paper stock, of polymer, and the drainage time for 500 ml of filtrate in the Schopper-Riegler tester and the optical transmittance were determined. The following results were obtained:

TABLE 2

| | Addition to the paper stock | Drainage time [sec] | Optical transmittance [%] |
|---|---|---|---|
| Example 2 | Polymer 1 | 58.3 | 34 |
| Comp. Example 4 | Polymer 4 | 67.9 | 28 |
| Comp. Example 5 | Polymer 5 | 60.6 | 28 |
| Comp. Example 6 | — | 71.2 | 9 |

EXAMPLE 3

A pulp was prepared from 100% unbleached sulfate pulp having a consistency of 5 g/l. The pH was 7.9. A sample of this paper stock and samples of this stock which contained the additives stated in Table 3 in an amount of 0.02%, based on dry fibers, of polymer were drained in a Schopper-Reigler tester. The drainage time was determined for 500 ml of filtrate in the tester. The results obtained are shown in Table 3.

TABLE 3

| | Addition to the paper stock | Drainage time [sec] | Optical transmittance [%] |
|---|---|---|---|
| Example 3 | Polymer 2 | 55.7 | 88 |
| Comp. Example 7 | Polymer 4 | 64.9 | 86 |
| Comp. Example 8 | Polymer 5 | 69.9 | 81 |
| Comp. Example 9 | — | 132.6 | 58 |

We claim:

1. A process for the production of paper, board and cardboard from a paper stock containing foreign substance, comprising draining the paper stock in the presence of a polymer which contains as polymerized constituents, units of the formulae:

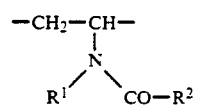

(I)

and

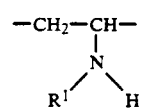

(II)

where $R^1$ and $R^2$ are each independently H or $C_1$–$C_3$-alkyl, and which has a K value of not less than 13 (determined according to H. Finkentscher in 5% strength by weight aqueous sodium chloride solution at 25° C. and at a polymer concentration of 0.1% by weight), and in which the content of units of the formula II is greater than or equal to 1 mol% and less than 10 mol%.

2. A process as claimed in claim 1, wherein said polymer contains the units of formula II in amounts of from 1 to 9 mol%.

3. A process as claimed in claim 1, wherein $R^1$ and $R^2$ of the formulae I and II are each hydrogen.

* * * * *